US008985332B2

(12) United States Patent
Kuo et al.

(10) Patent No.: US 8,985,332 B2
(45) Date of Patent: Mar. 24, 2015

(54) ASSEMBLED PACKING CASE

(71) Applicant: Shenzhen China Star Optoelectronics Technology Co., Ltd., Shenzhen, Guangdong (CN)

(72) Inventors: Yi-cheng Kuo, Guangdong (CN); Shih Hsiang Chen, Guangdong (CN); Jiaxin Li, Guangdong (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 0 days.

(21) Appl. No.: 13/825,007

(22) PCT Filed: Feb. 1, 2013

(86) PCT No.: PCT/CN2013/071283

§ 371 (c)(1),
(2) Date: Mar. 18, 2013

(87) PCT Pub. No.: WO2014/114014

PCT Pub. Date: Jul. 31, 2014

(65) Prior Publication Data

US 2014/0202909 A1 Jul. 24, 2014

(51) Int. Cl.

| | |
|---|---|
| ***B65D 85/48*** | (2006.01) |
| ***B65D 81/02*** | (2006.01) |
| ***B65D 6/00*** | (2006.01) |

(52) U.S. Cl.

CPC ..... *B65D 11/10* (2013.01); *B65D 85/48* (2013.01)

USPC ..... 206/454; 206/523; 206/591; 206/592; 220/7

(58) Field of Classification Search

USPC ..... 206/449, 454, 521, 523, 586–592; 220/6, 7

See application file for complete search history.

(56) References Cited

U.S. PATENT DOCUMENTS

| | | | | | |
|---|---|---|---|---|---|
| 3,854,650 | A * | 12/1974 | Hanaue | 206/521 |
| 4,972,954 | A * | 11/1990 | Dickie | 206/523 |
| 5,184,727 | A * | 2/1993 | Dickie et al. | 206/591 |
| 5,207,327 | A * | 5/1993 | Brondos | 206/523 |
| 6,082,543 | A * | 7/2000 | Beliveau | 206/523 |
| 6,868,965 | B2 * | 3/2005 | Miller et al. | 206/591 |
| 7,114,618 | B2 * | 10/2006 | Arnold | 206/523 |
| 7,398,884 | B2 * | 7/2008 | Stegner et al. | 206/592 |
| 7,878,332 | B2 * | 2/2011 | Stegner et al. | 206/592 |

* cited by examiner

*Primary Examiner* — Bryon Gehman

(57) ABSTRACT

The present invention relates to an assembled packing case, which comprises a bottom component with a criss-cross underside, corner components embedded to vacant corners of the bottom component, and limiting holes provided at embedding positions between the bottom component and the corner components; wherein the assembled packing case further comprises fasteners inserted into the limiting holes to define the relative position between the bottom component and the corner components; the bottom component and the corner components are set as mortise and tenon structures at the embedding positions, and the mortise and tenon structures limit the relative displacement between the bottom component and corner components in the vertical direction; and the corner components are embedded to the bottom component to form a case body by the mortise and tenon structures. The structure of the assembled packing case is simple and the cost is low.

14 Claims, 3 Drawing Sheets

ASSEMBLED PACKING CASE

FIELD OF THE INVENTION

The present invention relates to packing technique, and more particularly to an assembled packing case.

BACKGROUND OF THE INVENTION

Different kinds of glass plate are needed during the production of the liquid crystal display module, and the glass plate must be protected with special packing technique to avoid damage of the glass plate due to the collision, vibration, friction during the transportation because the glass plate is a kind of fragile and vulnerable material. Generally, the existing way for packing glass plate is filling cushioning material, for example, expanded polypropylene plastic material (expanded polypropylene, EPP), between the glass plates to avoid the damage of the glass plate. However, this way for packing glass plate costs a lot for it needs plenty of cushioning material. Furthermore, the overall volume will be big, and it will take up more space when multi-layer glass plates are packed together because cushioning material needs to be filled between each two glass plates.

SUMMARY OF THE INVENTION

Aiming at the defects of the packing case of glass plate in the prior art of costing a lot and taking up more space, the technical problem to be solved by the present invention is to provide an packing case with simple and compact structure and low cost.

The present invention adopts the following technical solution to solve its technical problem: an assembled packing case is provided, comprising a bottom component with a criss-cross underside, corner components embedded to vacant corners of the bottom component, and limiting holes provided at embedding positions between the bottom component and the corner components; wherein a half of the limiting hole is set on the bottom component and a half of the limiting hole is set on the corner component; the assembled packing case further comprises fasteners inserted into the limiting holes to define the relative position between the bottom component and the corner components; the bottom component and the corner components are set as mortise and tenon structures at the embedding positions, and the mortise and tenon structures limit the relative displacement between the bottom component and corner components in the vertical direction; and the corner components are embedded to the bottom component to form a case body by the mortise and tenon structures.

The assembled packing case according to the present invention, wherein the assembled packing case further comprises a scaleboard, and the shape of an underside of the scaleboard matches with the shape of the underside of the bottom component; and the scaleboard is embedded on the bottom component; the scaleboard is provided with stop blocks for limiting positions of objects to be packed, and the stop blocks are integrated with the scaleboard.

The assembled packing case according to the present invention, wherein the scaleboard is provided with stop blocks for limiting position of objects to be packed, and the stop blocks are integrated with the scaleboard.

The assembled packing case according to the present invention, wherein the bottom component is provided with case body barricades and the corner components are provided with corner barricades; and the case body barricades and corner barricades form a hold space.

The assembled packing case according to the present invention, wherein gaskets are stuck on the case body barricades and corner barricades.

The assembled packing case according to the present invention, wherein the gaskets are cushioning plate made from any one kind material of expanded polypropylene plastic material, expandable polyethylene or expanded polystyrene.

The assembled packing case according to the present invention, wherein the case body barricades are embedded on the bottom component, or the case body barricades are integrated with the bottom component.

The assembled packing case according to the present invention, wherein the corner barricades are embedded on the bottom component, or the corner barricade are integrated with the bottom component.

An assembled packing case is provided, comprising a bottom component with a criss-cross hollow underside, corner components embedded to vacant corners of the bottom component, and limiting holes provided at embedding positions between the bottom component and the corner components; wherein a half of the limiting hole is set on the bottom component and a half of the limiting hole is set on the corner component; the assembled packing case further comprises fasteners inserted into the limiting holes to define the relative position between the bottom component and the corner components; the bottom component and the corner components are set as mortise and tenon structures at the embedding positions, and the mortise and tenon structures limit the relative displacement between the bottom component and corner components in the vertical direction; and the corner components are embedded to the bottom component to form a case body by the mortise and tenon structures.

The assembled packing case according to the present invention, wherein the assembled packing case further comprises a scaleboard, and the underside shape of the scaleboard matches with the underside shape of the bottom component; the scaleboard is embedded on the bottom component; the scaleboard is provided with stop blocks for limiting position of objects to be packed, and the stop blocks are integrated with the scaleboard.

The assembled packing case according to the present invention, wherein the bottom component is provided with case body barricades and the corner components are provided with corner barricades; and the case body barricades and corner barricades form a hold space; and gaskets are stuck on the case body barricades and corner barricades.

The assembled packing case according to the present invention, wherein the gaskets are cushioning plate made from any one kind material of expanded polypropylene plastic material, expandable polyethylene or expanded polystyrene.

The assembled packing case according to the present invention, wherein the case body barricades are embedded on the bottom component, or the case body barricades are integrated with the bottom component.

The assembled packing case according to the present invention, wherein the corner barricades are embedded on the bottom component, or the corner barricade are integrated with the bottom component.

The assembled packing case of the present invention has the following beneficial effects: the packing case is formed by connected structures without thread, riveting, or welding, and the packing case can protect objects to be packed, because it fits objects to be packed perfectly. The conformation of the assembled packing case is simple and compact. The assembled packing case is suitable for packed objects with different size by changing bottom component. The cost can be highly reduced by reusing the corner components.

BRIEF DESCRIPTIONS OF THE DRAWINGS

The present invention will further be explained with reference to drawings. In the drawings.

DETAILED DESCRIPTION OF THE EMBODIMENTS

Figure 1:
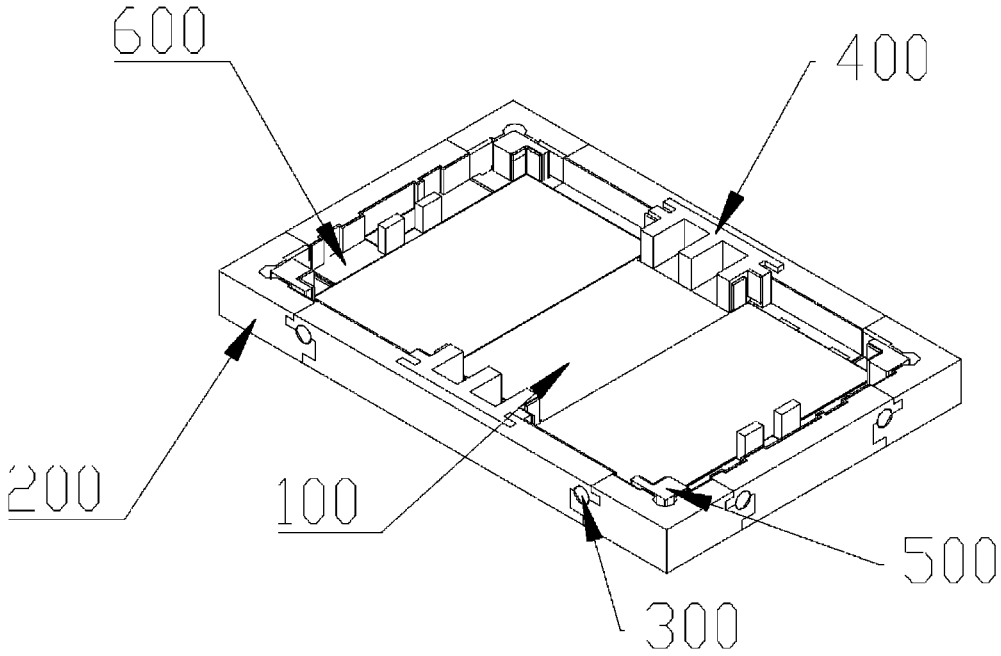
FIG. 1 is a structural schematic drawing of a preferred embodiment of the assembled packing case of the present invention.
Figure 2:
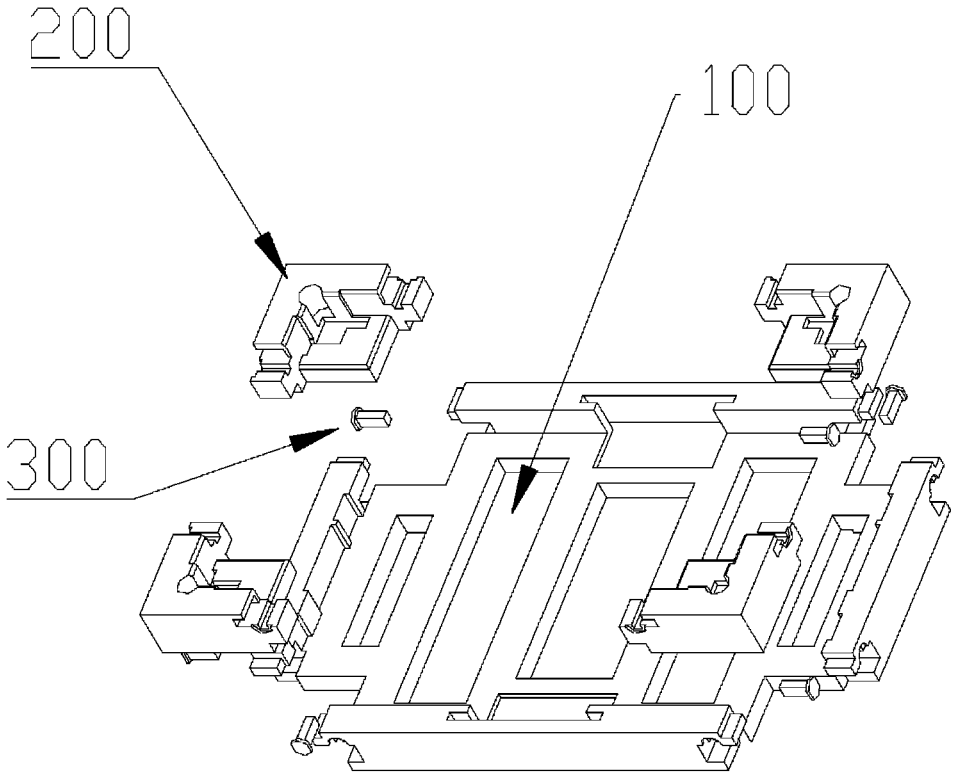
FIG. 2 is an explosive view of the assembled packing case shown in FIG. 1.

FIG. 1 is a structural schematic drawing of a preferred embodiment of the assembled packing case of the present invention, and FIG. 2 is an explosive view of the assembled packing case of this embodiment. In this embodiment, the assembled packing case comprises a bottom component 100 and corner components 200 that embedded to the corner of the bottom component 100. Limiting holes are set at the embedding positions of the bottom component 100 and the corner components 200, and the assembled packing case further comprises fasteners 300 that insert into the limiting holes, when the fasteners 300 are inserted, the relative position between the bottom component 100 and the corner components 200 will be limited. The underside of the bottom component 100 is criss-cross, and the shape of the corner components 200 is consistent with the shape of the four corners of the corner component 200, a cuboid case body with a hold space will be formed and various objects can be placed when the bottom component 100 and corner components 200 are assembled together. Herein, the criss-cross underside means the underside is a crossing intersecting structure.

The assembled packing case of this embodiment is particularly suitable for packing and transporting clintheriform fragile objects such as glass plates, case body barricades 400 are set on the bottom component 100 and corner barricades 500 are set on the corner components 200. The hold space, which is formed by the case body barricades 400 and the corner barricades 500, is as large as the glass plate that to be placed, therefore the glass plate will not move freely in the packing case, so the glass plate won't be damaged.

In order to further protect the glass plate, gaskets are stuck on the case body barricades 400 and the corner barricades 500. Usually, the gaskets are made from plastic materials with excellent cushioning performance, for example, EPP, expandable polyethylene (expandable polyethylene, EPE), polystyrene (expanded polystyrene, EPS), etc.

As shown in FIG. 2, the bottom component 100 in this embodiment is hollow. The bottom component 100 with hollow structure can reduce the contact area between the bottom component 100 and the glass plates when the glass plates placed into the packing case, so it can avoid scuffing of the glass plate and reduce the overall weight of the packing case.

In this embodiment, the case body barricades 400 and corner barricades 500 can be embedded on the bottom component 100 and corner components 200. The case body barricades 400 and corner barricades 500 can also be integrated with the bottom component 100 and corner components 200. As shown in FIG. 1 and FIG. 2, when embedded on the bottom component 100 and corner components 200, slots need to be set on the bottom component 100 and corner components 200. In the present invention, the embedding way is preferred: case body barricades 400 and corner barricades 500 with different sizes can be replaced for packing glass plates with different sizes, so as to arrange the glass plates immovably in the assembled packing case.

Figure 3:
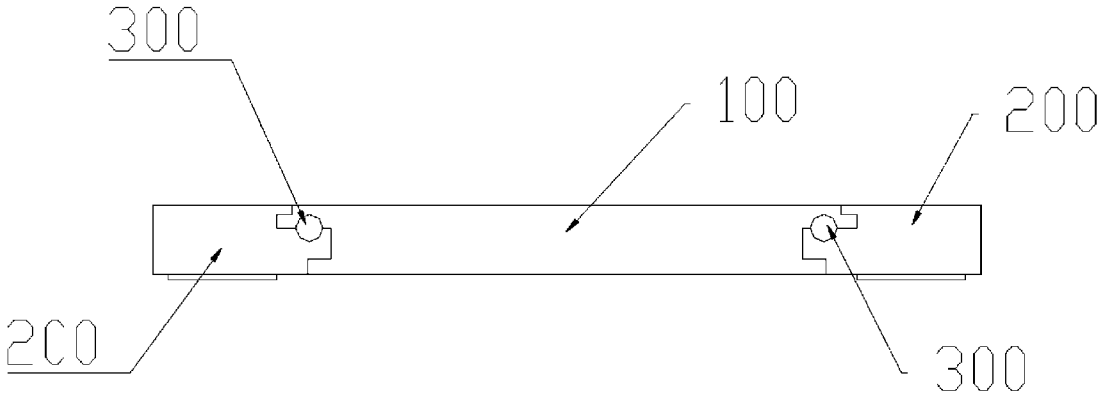
FIG. 3 is a lateral view of the assembled packing case shown in FIG. 1.

The way that the bottom component 100 and corner components 200 are assembled into a packing case will be detailed in the following description with reference to FIG. 1 to FIG. 3. At the side of the assembled packing case, the bottom component 100 and corner components 200 are set as mortise and tenon structures at the embedding positions between the bottom component and the corner, so the tenons of the bottom component 100 could be embedded into the mortises of the corner component 200 (it is corresponding that the tenons of the corner component 200 could be embedded into the mortises of the bottom component 100). Limiting holes are set at the embedding position of the bottom component 100 and the corner components 200, that is, a half of the limiting hole is set on the bottom component 100 and a half of the limiting hole is set on the corner component 200. The complete limiting holes will be formed when the bottom component 100 and the corner component 200 are assembled. Then a fastener 300 is inserted into the limiting hole, as shown in FIG. 3. The number of the mortises and tenons is not limited in the present invention. For example, there is one tenon and one mortise on the bottom component 100 and the corner component 200 respectively, as long as the relative displacement between the bottom component 100 and corner components 200 on the vertical direction is limited by the mortise and tenon.

As shown in lateral view of FIG. 3, the relative displacement between the bottom component 100 and corner components 200 on the vertical direction is impossible because of the interaction of the mortise and tenon. On the horizontal direction, the relative displacement between the bottom component 100 and corner components 200 is impossible because of the embedding fasteners. In the direction perpendicular to the paper, the relative displacement will be restricted by another fastener. So, every corner component 200 will be fastened to the bottom component 100 by two fasteners 300 without thread, riveting, nor welding.

As the whole assembled packing case is formed by embedding corner components 200 to bottom component 100, we can produce bottom components 100 with different size, and can replace the bottom component for packing objects with different size. Thereby, the versatility of the assembled packing case will be improved.

The shape of fastener 300 is not limited in the present invention. For example, the fastener shown in FIG. 2 and FIG. 3 is a square column with a dome, and it can also be replaced by other shapes, as long as it can limit the bottom component 100 and corner component 200.

Figure 4:
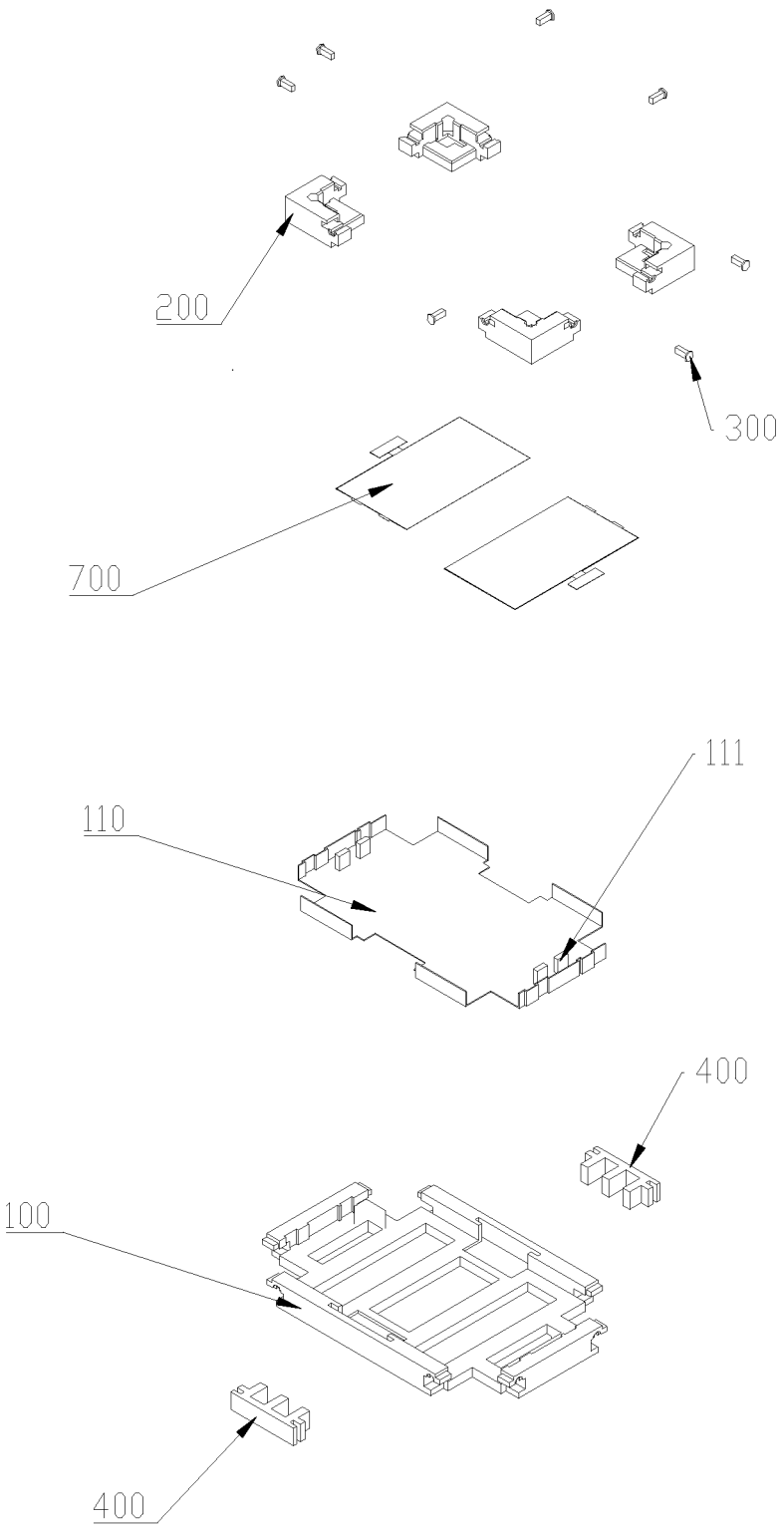
FIG. 4 is a structural schematic drawing of the assembled packing case that packing liquid crystal panels.

The present invention will further be explained how to assemble liquid crystal panel with reference to FIG. 4. Usually, the liquid crystal panel 700 is a rectangular liquid crystal cell with PCB extending on one side. When we transport and preserve the liquid crystal panel, we should make sure that the liquid crystal cell will not be damaged due to collision and the PCB will not be folded. A scaleboard 110 is embedded above the hollow-out bottom component 100, and the underside shape of the scaleboard 110 matches with the underside shape of the bottom component 100. Stop blocks 111 are arranged on the scaleboard 110, and the stop blocks 111 are integrated with the scaleboard 110 to limit the position of the PCB of the Liquid crystal panel 700 to prevent PCB folded. The position of the stop blocks 111 can be selected according to size of the LED panel. In this embodiment, the scaleboard 110 can pack two same Liquid crystal panels 700 with small surface at the same time. When we need to pack and transport larger Liquid crystal panel, we can replace it with a scaleboard 110 which is provided with appropriate stop block 111, so that the same one assembled packing case can fit the Liquid crystal panels with various sizes, and the versatility of the assembled packing case will be improved and the cost will be reduced.

A bottom component 100 with half-baked hold space will be formed after the scaleboard 110 embedded above the hollow-out bottom component 100 and packing case barricade 400 embedded in the bottom component 100. Then a complete rectangle packing case will be formed when corner components 200 embedded to the four corners of the bottom component 100. At last, insert the fasteners 300 to the limiting holes to make sure no relative displacement will occur between the corner components 200 and bottom component 100. At this time, the hold space will be formed which matches with the Liquid crystal panel 700. After the Liquid crystal panel 700 placed in the assembled packing case, the Liquid crystal panel 700 is immovable and its PCB board won't be folded, so the Liquid crystal panel 700 will be protected during transportation.

Aiming at size of the Liquid crystal panel, position of the PCB board and demand of packaging and transporting, we can combine different bottom components 100, scaleboards 110 and corner components 200, so the applicability of the assembled packing case will be improved.

The above examples are used only for explaining the technical concept and features of the present invention. They are provided to make those skilled in the art understand the present invention and implement it, and cannot thereby limit the extent of protection of the present invention. Any equivalent alteration and modification within the scope of the claims of the present invention shall fall within the scope of the claims of the present invention.

What is claimed is:

1. An assembled packing case, comprising a bottom component with a criss-cross underside, corner components embedded to vacant corners of the bottom component, and limiting holes provided at embedding positions between the bottom component and the corner components; wherein a half of the limiting hole is set on the bottom component and a half of the limiting hole is set on the corner component; the assembled packing case further comprises fasteners inserted into the limiting holes to define the relative position between the bottom component and the corner components; the bottom component and the corner components are set as mortise and tenon structures at the embedding positions, and the mortise and tenon structures limit the relative displacement between the bottom component and corner components in the vertical direction; and the corner components are embedded to the bottom component to form a case body by the mortise and tenon structures.

2. The assembled packing case according to claim 1, wherein the assembled packing case further comprises a scaleboard, the shape of an underside of the scaleboard matches with the shape of the underside of the bottom component; and the scaleboard is embedded on the bottom component.

3. The assembled packing case according to claim 2, wherein the scaleboard is provided with stop blocks for limiting positions of objects to be packed, and the stop blocks are integrated with the scaleboard.

4. The assembled packing case according to claim 1, wherein the bottom component is provided with case body barricades and the corner components are provided with corner barricades; and the case body barricades and corner barricades form a hold space.

5. The assembled packing case according to claim 4, wherein gaskets are stuck on the case body barricades and corner barricades.

6. The assembled packing case according to claim 5, wherein the gaskets are cushioning plate made from any one of expanded polypropylene plastic material, expandable polyethylene and expanded polystyrene.

7. The assembled packing case according to claim 4, wherein the case body barricades are embedded on the bottom component, or the case body barricades are integrated with the bottom component.

8. The assembled packing case according to claim 4, wherein the corner barricades are embedded on the bottom component, or the corner barricades are integrated with the bottom component.

9. An assembled packing case, comprising a bottom component with-a criss-cross hollow underside, corner components embedded to vacant corners of the bottom component, and limiting holes provided at embedding positions between the bottom component and the corner components; wherein a half of the limiting hole is set on the bottom component and a half of the limiting hole is set on the corner component; the assembled packing case further comprises fasteners inserted into the limiting holes to define the relative position between the bottom component and the corner components; the bottom component and the corner components are set as mortise and tenon structures at the embedding positions, and the mortise and tenon structures limit the relative displacement between the bottom component and corner components in the vertical direction; and the corner components are embedded to the bottom component to form a case body by the mortise and tenon structures.

10. The assembled packing case according to claim 9, wherein the assembled packing case further comprises a scaleboard, and the shape of an underside of the scaleboard matches with the shape of the underside of the bottom component; and the scaleboard is embedded above the bottom component; the scaleboard is provided with stop blocks for limiting positions of objects to be packed, and the stop blocks are integrated with the scaleboard.

11. The assembled packing case according to claim 9, wherein the bottom component is provided with case body barricades and the corner components are provided with corner barricades; and the case body barricades and corner barricades form a hold space; and gaskets are stuck on the case body barricades and corner barricades.

12. The assembled packing case according to claim 11, wherein the gaskets are cushioning plate made from any one of expanded polypropylene plastic material, expandable polyethylene and expanded polystyrene.

13. The assembled packing case according to claim 11, wherein the case body barricades are embedded on the bottom component, or the case body barricades are integrated with the bottom component.

14. The assembled packing case according to claim 11, wherein the corner barricades are embedded on the bottom component, or the corner barricades are integrated with the bottom component.

* * * * *